United States Patent [19]

Jarecki

[11] 4,018,341

[45] Apr. 19, 1977

[54] MERCHANDISE DISPLAY DEVICE

[75] Inventor: James J. Jarecki, Greendale, Wis.

[73] Assignee: E Z Painter Corporation, Milwaukee, Wis.

[22] Filed: May 5, 1975

[21] Appl. No.: 574,705

Related U.S. Application Data

[63] Continuation-in-part of Ser. No. 512,544, Oct. 7, 1974, abandoned.

[52] U.S. Cl. ..... 211/59.1; 248/220.4; 248/223.4; 248/309 A

[51] Int. Cl.² ..... A47F 7/00

[58] Field of Search ..... 248/216, 220.5, 221, 248/223, 224–225, DIG. 3, 110, 247, 248, 309–310, 311; 211/57, 59, 54, 65, 66, 49, 86, 87

[56] References Cited

UNITED STATES PATENTS

| | | | |
|---|---|---|---|
| 808,864 | 1/1906 | McLaughlin | 211/59 |
| 1,416,969 | 5/1922 | O'Connor | 211/59 |
| 2,872,145 | 2/1959 | Goldshell | 248/223 |
| 2,921,393 | 1/1960 | Wood | 248/223 X |
| 3,245,547 | 4/1966 | Felkay | 211/59 |
| 3,252,678 | 5/1966 | Myers et al. | 211/59 X |
| 3,272,468 | 9/1966 | Wittrock | 248/DIG. 3 |
| 3,448,956 | 6/1969 | Kuhaneck, Jr. | 248/311 X |
| 3,672,621 | 6/1972 | Bambenek | 248/223 |

*Primary Examiner*—Roy D. Frazier
*Assistant Examiner*—Terrell P. Lewis

[57] ABSTRACT

A hanger device to be used with a perforated panel or other display board or support for hanging articles in a position for visual display to customers. The hanger includes a mounting portion with two generally flat arms extending outwardly therefrom, one arm being angled generally upwardly and the other arm being angled generally downwardly. The upwardly directed arm supports a plurality of paint brushes or other suitable articles by means of apertures in the paint brush handles generally complementary in shape to the arm for maintaining vertical alignment of the brushes. The second downwardly angled arm maintains the hanging objects at an upwardly facing angle relative to the display board to facilitate viewing of the objects by a potential customer.

13 Claims, 5 Drawing Figures

FIG. 1
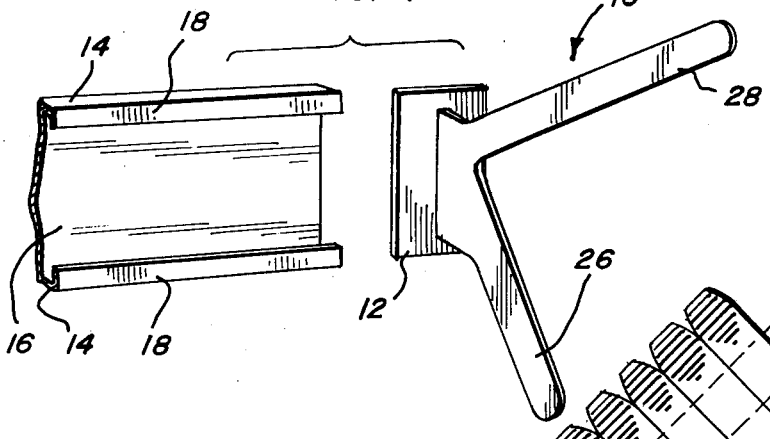
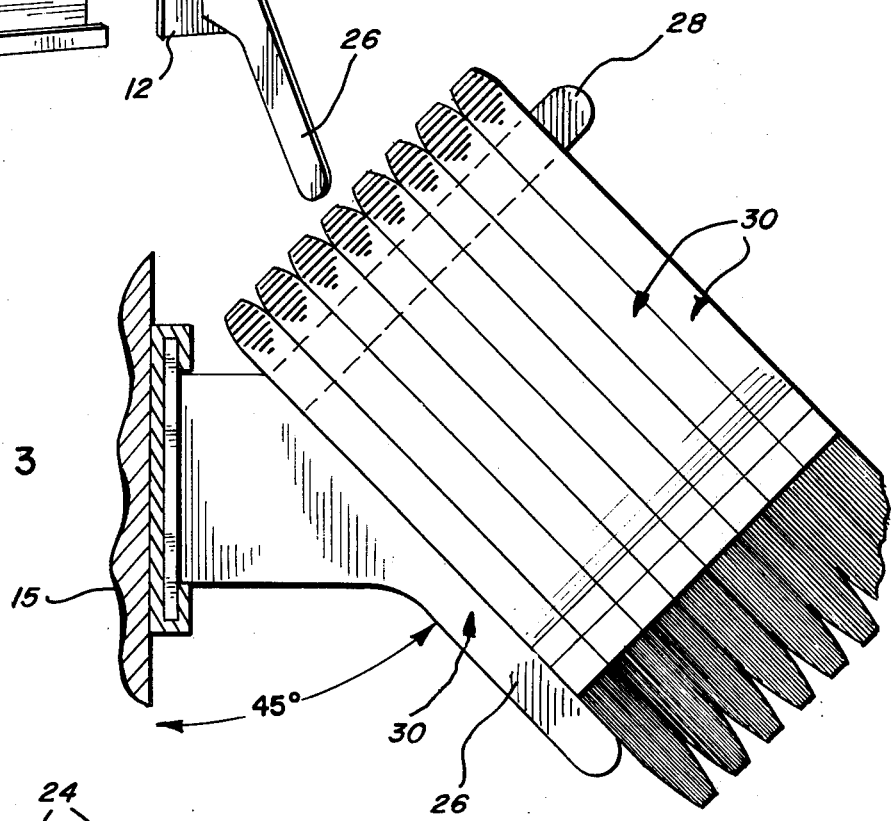
FIG. 3
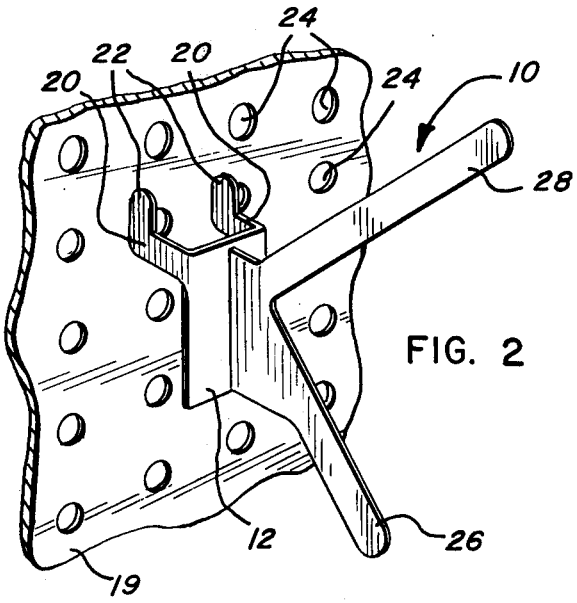
FIG. 2
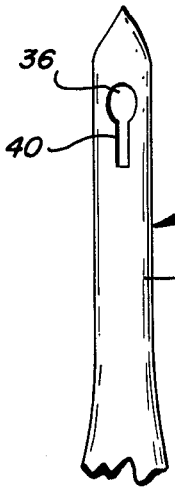
FIG. 4

MERCHANDISE DISPLAY DEVICE

BACKGROUND OF THE INVENTION

CROSS REFERENCE TO OTHER APPLICATIONS

This is a continuation-in-part of Applicant's copending application Ser. No. 512,544 filed Oct. 7, 1974, now abandoned and entitled MERCHANDISE DISPLAY DEVICE and assigned to the assignee of the present invention.

Field of the Invention

The invention relates to hangers for displaying and manual dispensing of articles of merchandise.

Description of the Prior Art

Hangers have been produced and sold which are capable of maintaining vertical alignment of the successively stacked or hung articles. The most common type uses a hanging member having a width dimension comprising a metal support or the combination of two or more cylindrical spaced apart rods.

The major disadvantage with the prior art hangers is that the articles which are displayed thereon hang vertically and therefore the articles hung on the lower portion of the display panel are not easily viewed by customers of average height unless they bend down or stoop. This is particularly important since many displayed articles often contain information relating to their intended use and the price on the article itself.

SUMMARY OF THE INVENTION

It is an object of the present invention to provide a new and improved hanger which, while maintaining proper vertical alignment between the displayed articles, also cants the articles upwardly to enable the average customer to easily read and view the articles.

In accordance with the object of the present invention, a hanger is provided which includes a mounting portion suitable for mounting on a conventional pegboard, mounting strip, or other suitable means, for hanging articles of manufacture for display. The hanger includes a generally flat portion in a vertical plane, having an upwardly directed flat arm for pendently supporting the articles in vertical alignment and a downwardly directed positioning arm for supporting the articles in a canted position with respect to the display panel. The articles have complementarily shaped slotted apertures for receiving the flat upper arm.

Other objects, features and advantages of the invention will be apparent when viewed in light of the accompanying drawings and detailed description.

BRIEF DESCRIPTION OF THE DRAWINGS

FIG. 1 is an exploded perspective view of one form of hanger according to the present invention with one type of hanger support;

FIG. 2 is another exploded view, similar to FIG. 1, showing the hanger of the present invention employing an alternate means of support;

FIG. 3 is a side elevational view of the hanger of FIG. 1, in section through the hanger support, and displaying a plurality of hanging paint brushes;

FIG. 4 is a fragmented elevational view illustrating the keyhole type mounting aperture in a paint brush handle, suitable for use with the present invention.

DESCRIPTION OF THE PREFERRED EMBODIMENT

Figure 5:
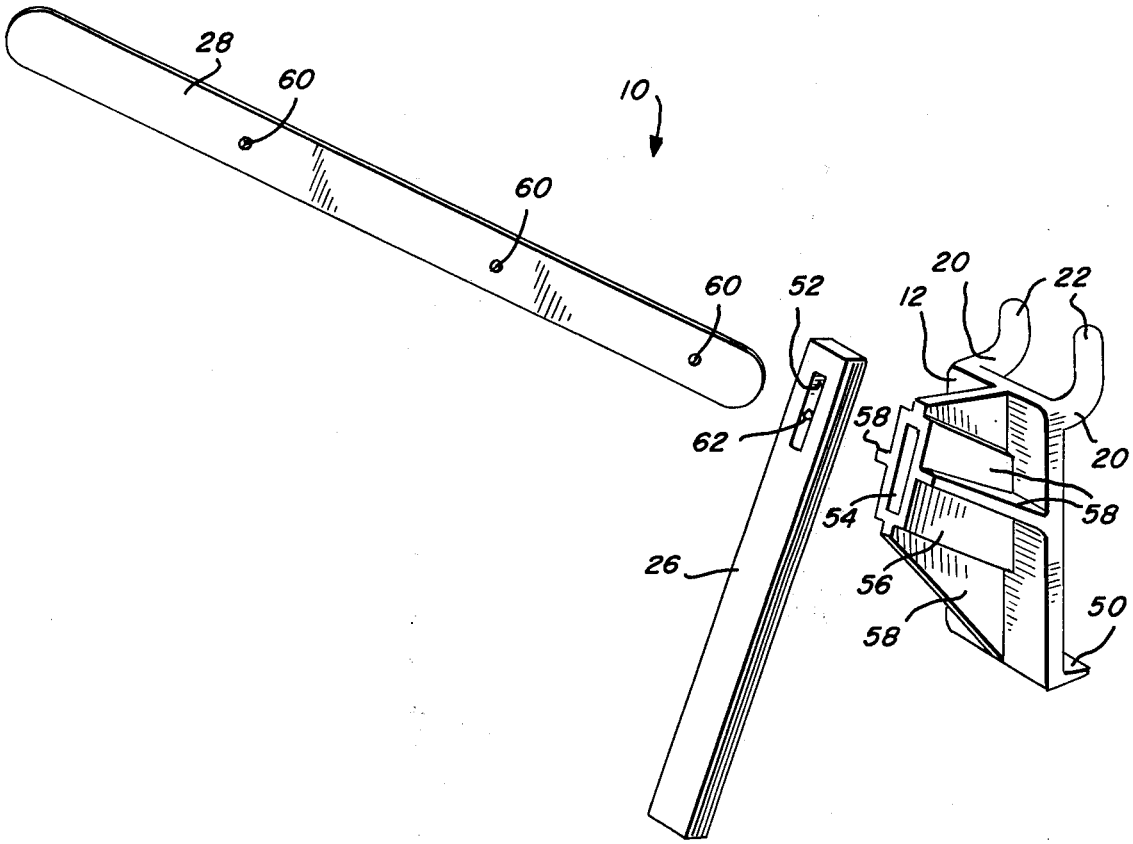
FIG. 5 is an exploded perspective view of an alternate form of the hanger according to the present invention.

Referring to FIG. 1, a hanger according to the present invention, generally designated 10, includes a flat rectangular mounting base portion 12 for slidable engagement within the flanges 14 of a channel support member 16. Each of the flanges includes an inwardly turned lip 18 which slidably secures the base 12 within the channel 16. The channel can be fixed to a wall 15, display board or stand, or other suitable support. A plurality of parallel channels 16 can be mounted on a suitable display board providing for the use of a large number of hangers 10 for supporting articles of manufacture.

FIG. 2 shows the hanger 10 of the present invention having an alternative type of mounting base for mounting on a pegboard 19. The base includes a similar rectangular portion 12 having two rearwardly directed flanges 20 formed at the upper corners thereof. Each of the flanges 20 includes an upwardly directed tab 22. In this embodiment, the hanger 10 is mounted on the pegboard 19 by introducing the tabs 22 into a pair of adjacent holes 24 and then rotating the hanger downwardly approximately 90°. The flange members 20 vertically support the hanger 10 while the tab members 22 prevent the hanger from falling off of the pegboard 19.

In both of the embodiments shown in FIGS. 1 and 2, the hanger is flat in a vertical direction and includes a downwardly angled positioning arm member 26. The positioning arm 26 forms an angle of approximately 45° with the display panel 15 or pegboard 19. An upwardly directed hanging arm member 28 is formed integrally with the positioning arm 26 and extends upwardly and outwardly to form an angle of approximately 90° with the positioning arm. The positioning arm 26 and the hanging arm 28 are formed from sufficiently rigid sheet material of metal, plastic or the like.

FIG. 3 shows the hanger 10 of the present invention supporting a plurality of paint brushes 30 on the display panel 15. FIG. 4 shows a handle 32 of one of the paint brushes 30. The handle includes a keyhole type slot which has a circular enlargement 36 at its uppermost end and a bottom vertical slot portion 40. The circular hole 36 enables the paint brushes to be displayed on conventional rod-type pegboard hangers as well as with the hanger of the present invention.

FIG. 5 shows an alternate embodiment of the hanger 10 of the present invention. Many of the components of the alternate embodiment are similar to the first embodiment and therefore like numerals will be used to identify like components. The alternate embodiment of the hanger 10 includes a similar rectangular mounting base portion 12 having two rearwardly directed L-shaped hook members 20 formed at the upper corners thereof. Each of the hooks 20 includes an upwardly directed portion 22. In this alternate embodiment, the hanger 10 is mounted on the pegboard 19 by introducing the portions 22 into a pair of adjacent holes 24 and then rotating the hanger downwardly approximately 90° as shown by the hanger in FIG. 2. The hook members 20 vertically support the hanger 10 with the portions 22 preventing the hanger from falling off of the pegboard 19. Additionally, a generally horizontal rearwardly directed transverse flange 50 is provided on the lower edge of the rectangular mounting base 12 to engage the pegboard 19 and maintain the rectangular base in a substantially vertical orientation.

The alternate embodiment includes a removable, upwardly angled flat hanging arm member 28 and a removable downwardly angled positioning arm member 26. Again the positioning arm 26 forms an angle of approximately 45° with the display panel 15 or pegboard 19 to maintain the paint brushes in an easily observable canted position. In the alternate embodiment, the positioning arm 26 includes a generally rectangular aperture 52 near one end thereof which slidably receives the hanging arm member 28 to maintain a stable, non-rotatable relationship with respect thereto. The flat hanging arm member, as above, is inserted through the slots 40 in the paint brushes and maintains their vertical alignment.

The hanging arm 28 is inserted into a complementary rectangular aperture 54 formed in a rectangular boss 56 connected to or molded integrally with the rectangular base 12. The boss 56 is directed generally upwardly to define the particular angle of the hanging arm. A plurality of generally triangular fins 58 are connected to or molded integrally with the boss 56 and the rectangular base 12 to add strength and rigidity to the hanging arm member 28. The front canted faces of the boss 56 and fins 58 define an abutment surface for the positioning arm 26 which, along with its fit with the hanging arm in its aperture 54, maintains the arm in its angled disposition.

Additionally, in this alternate embodiment, a plurality of holes 60 are provided along the length of the hanging arm member 28 so that the positioning arm 26 can be moved upwardly along the arm 28 to move the articles closer to the potential customer. It is desirable to be able to move the positioning arm outward along the length of the hanging arm to hold the displayed items, such as paint brushes, or the like, near the upper end of the hanging arm when the inventory becomes depleted. This also facilitates the removal of one or two items by a customer since he does not have to slide the items along the entire length of a substantially empty hanging arm member 28.

To this end, detent means in the form of a raised crown or nipple 62 may be provided on the interior, generally vertical walls of the aperture 52 in alignment with the holes 60 to permit interlocking of the positioning arm 26 along the hanging member 28. For example, if the positioning arm 26 were made of a resilient plastic, the walls thereof could flex substantially to permit the interior nipples to engage the apertures 60. Alternately, pins or bolts may be inserted through the holes 60 behind the positioning arm 26 to maintain the arm in a desired longitudinal disposition along the hanging arm 28.

When used with the present invention, the vertical slot 40 engages the width of either embodiment of the hanger arms 28 and maintains relative vertical alignment of the paint brushes 30 with respect to one another. The positioning arms 26 engage one side of the bottom stacked paint brush 30, as seen in FIG. 3, to maintain it in a canted position relative to the display panel 15. The remaining brushes 30 will be stacked on top of the first paint brush and hang in the same inclination while the hanging arm 28 maintains vertical alignment between the brushes. In this manner, all of the paint brushes or other articles are held with the fronts thereof directed upwardly to a potential customer so that the pricing information and other description of the articles can be easily viewed by the customer regardless of their positioning height relative to the floor. Another advantage of hanging display items in this manner is that the capacity of the display board is increased because the angularly hanging paint brushes or other articles require less vertical space than those which hang in a pure vertical orientation.

The foregoing detailed description has been given for clearness of understanding only and no unnecessary limitations should be understood therefrom as some modifications will be obvious to those skilled in the art.

I claim:

1. A hanger for securement to a support panel, or the like, for displaying a plurality of articles, said display hanger comprising:

a base including attachment means to secure the base to the support panel;

a generally upwardly canted, elongated hanging arm member secured to the base and protruding outwardly from the support panel for receiving a plurality of articles in stacked relationship therealong; and a generally downwardly canted positioning arm member movably mounted to the hanging arm member whereby the bottommost of said stacked plurality of articles on said hanging arm is supported in a generally upwardly canted position relative to the support panel with the remainder of the stacked articles so positioned seriatim to facilitate observance and access thereto.

2. The display hanger of claim 1 wherein the hanging arm member and positioning arm member are formed of substantially flat material and the articles include a generally elongated slot adapted to engage the hanging arm member to thereby maintain relative alignment between the articles.

3. The display hanger of claim 2 wherein the hanging arm member and positioning arm member are integrally formed from flat sheet material.

4. The display hanger of claim 3 wherein the hanging arm member and positioning arm member, when secured to the support panel, are disposed in a common, generally vertical plane.

5. Hanging means for supporting and displaying articles on a display board, or the like, comprising, in combination:

a hanger having a base portion for mounting on the display board and a substantially vertically flattened hanging arm member for receiving a plurality of articles in a stacked relationship;

a generally downwardly canted positioning arm member removably mounted on the hanging arm member whereby the bottommost of said stacked plurality of articles on said hanging arm is supported in a generally upwardly canted position relative to the support panel with the remainder of the stacked articles so positioned seriatim to facilitate observance and access thereto; and an article having a generally elongated vertical slot shaped aperture complementary in size and shape to said arm member for sliding engagement onto the hanging arm member for supporting the article and maintaining relative vertical alignment between a plurality of articles supported by the hanger.

6. The combination of claim 5 wherein the aperture in each article is generally keyhole-shaped with an enlarged rounded portion for accommodating a rod-like hanger as well as said flat hanger arm member.

7. A hanger for securement to a support panel or the like, for displaying a plurality of articles, said display hanger comprising:

a base portion having attachment means to secure the base to the support panel;

a generally upward canted, elongated hanging arm member removably mounted to the base so as to protrude outwardly from the support panel when mounted on the base for receiving a plurality of articles in a stacked relationship therealong; and a generally downwardly canted positioning arm member removably mounted on said hanging arm member whereby the bottommost of said stacked plurality of articles on said hanging arm member is supported in a generally upwardly canted position with the remainder of the stacked articles so positioned seriatim to facilitate observance and access thereto.

8. The display hanger of claim 7 wherein the positioning arm member includes detent means between said aperture and the hanging arm member to vary the longitudinal position of the positioning arm member along the hanging arm member.

9. The display hanger of claim 7 wherein the hanging arm member is removably mounted to the base in a complementarily shaped aperture formed in the base.

10. The display hanger of claim 7 wherein the positioning arm member is removably mounted to the hanging arm member in a complementarily shaped aperture which slidably receives the hanging arm member to maintain the positioning arm member in a non-rotatable relationship, generally perpendicular to the hanging arm member.

11. The display hanger of claim 7 wherein the positioning arm member includes detent means between said aperture and the hanging arm member to vary the longitudinal position of the positioning arm member along the hanging arm member.

12. A hanger for securement to a support panel, or the like, for displaying a plurality of articles, said display hanger comprising:

a base including attachment means to secure the base to the support panel;

a generally upwardly canted, elongated hanging arm member secured to the base and protruding outwardly from the support panel for receiving a plurality of articles in stacked relationship therealong; and a generally downwardly canted positioning arm member mounted below the hanging arm member whereby the bottommost of said stacked plurality of articles on said hanging arm is supported in a generally upwardly canted position with the remainder of the stacked articles so positioned seriatim to facilitate observance and access thereto, wherein the positioning arm member is removably mounted to the hanging arm member in a complementarily shaped aperture which slidably receives the hanging arm member to maintain the positioning arm member in a non-rotatable relationship, generally perpendicular to the hanging arm member.

13. The display hanger of claim 12 wherein the positioning arm member includes detent means between said aperture and the hanging arm member to vary the longitudinal position of the positioning arm member along the hanging arm member.

* * * * *

UNITED STATES PATENT AND TRADEMARK OFFICE

CERTIFICATE OF CORRECTION

PATENT NO. : 4,018,341

DATED : April 19, 1977

INVENTOR(S) : James J. Jarecki

It is certified that error appears in the above-identified patent and that said Letters Patent are hereby corrected as shown below:

Cover page - The name of the Assignee is incorrectly spelled and should be as follows:

EZ Paintr Corporation

Signed and Sealed this

Twenty-first Day of June 1977

[SEAL]

*Attest:*

RUTH C. MASON
*Attesting Officer*

C. MARSHALL DANN
*Commissioner of Patents and Trademarks*